United States Patent [19]

Baltz et al.

[11] Patent Number: 4,825,821

[45] Date of Patent: May 2, 1989

[54] CARBURETOR PULSE-BACK DAMPING SYSTEM FOR 2-CYCLE INTERNAL COMBUSTION ENGINE

[75] Inventors: Gene F. Baltz, Lake Villa, Ill.; Geoffrey S. Zgorzelski, Kenosha, Wis.

[73] Assignee: Outboard Marine Corporation, Waukegan, Ill.

[21] Appl. No.: 183,839

[22] Filed: Apr. 20, 1988

[51] Int. Cl.[4] ..... F02B 33/04

[52] U.S. Cl. ..... 123/73 A; 123/73 SP

[58] Field of Search ..... 123/73 A, 73 AD, 73 B, 123/73 C, 73 V, 73 SP, 73 PP

[56] References Cited

U.S. PATENT DOCUMENTS 4,333,425 6/1982 Kusche ..... 123/73 C 4,683,846 8/1987 Takayasu ..... 123/73 B

FOREIGN PATENT DOCUMENTS 0056222 5/1977 Japan ..... 123/73 C 0087818 7/1980 Japan ..... 123/73 SP

*Primary Examiner*—David A. Okonsky

*Attorney, Agent, or Firm*—Michael, Best & Friedrich

[57] ABSTRACT

Disclosed herein is a two stroke internal combustion engine comprising first and second alternately fired cylinders, first and second crankcases respectively extending from the first and second cylinders, first and second carburetors respectively including first and second air induction passages respectively extending from the first and second crankcases, first and second reed valves respectively affording communications between the first and second crankcases and the first and second air induction passages, first and second throttle valves respectively movably mounted in the first and second air induction passages, first and second idle speed ports respectively communicating with the first and second air induction passages in the respective areas between the first and second throttle valves and the first and second reed valves, and a conduit communicating between the first and second idle speed ports.

2 Claims, 1 Drawing Sheet

CARBURETOR PULSE-BACK DAMPING SYSTEM FOR 2-CYCLE INTERNAL COMBUSTION ENGINE

BACKGROUND OF THE INVENTION

Figure 1:
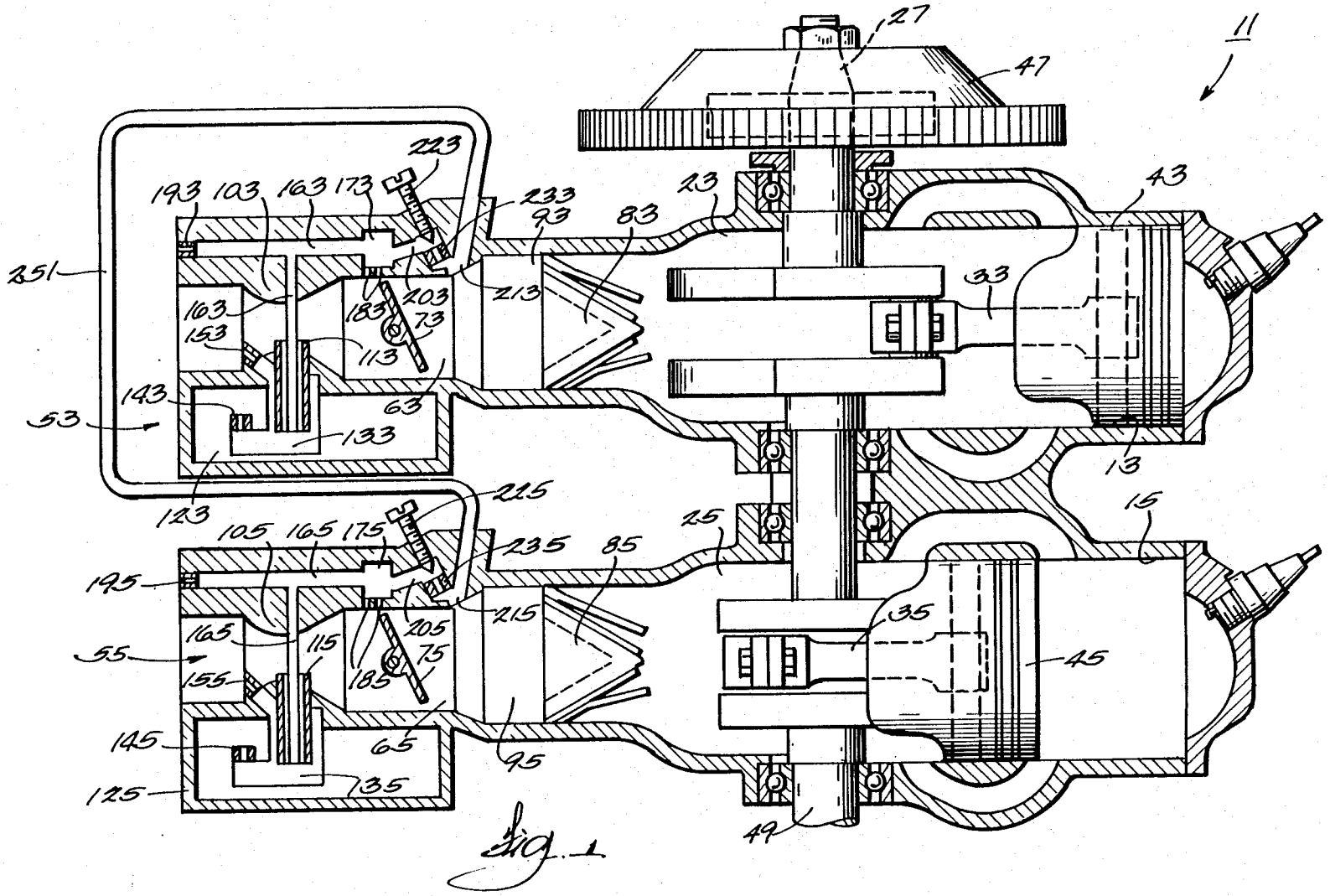

The invention relates generally to two-stroke cycle internal combustion engines. More specifically, the invention relates to alternately fired, twin cylinder, two-stroke cycle internal combustion engines and to carburetor systems therefor.

The invention is generally directed to obtaining improved engine operation during idle and low speed conditions.

SUMMARY OF THE INVENTION

The invention provides a two stroke internal combustion engine comprising first and second alternately fired cylinders, first and second crankcases respectively extending from the first and second cylinders, first and second carburetors respectively including first and second air induction passages respectively extending from the first and second crankcases, first and second reed valves respectively affording communication between the first and second crankcases and the first and second air induction passages, first and second throttle valves respectively movably mounted in the first and second air induction passages, first and second ports respectively communicating with the first and second air induction passages in the respective areas between the first and second throttle valves and the first and second reed valves, and means directly communicating between the first and second air induction passages in the respective areas between the first and second throttle valves and the first and second reed valves.

The invention also provides a two stroke internal combustion engine comprising first and second alternately fired cylinders, first and second crankcases respectively extending from the first and second cylinders, first and second carburetors respectively including first and second air induction passages respectively extending from the first and second crankcases, first and second reed valves respectively affording communication between the first and second crankcases and the first and second air induction passages, first and second throttle valves respectively movably mounted in the first and second air induction passages, first and second idle speed ports respectively communicating with the first and second air induction passages and respectively located between the first and second throttle valves and the first and second reed valves, and a conduit communicating between the first and second idle speed ports.

One of the principal features of the invention is the provision of an internal combustion engine having improved idle and low speed running characteristics.

Other features and advantages of the invention will become apparent to those skilled in the art upon review of the following detailed description, claims, and drawings.

THE DRAWING

FIG. 1 is a schematic view of a two-stroke cycle, alternately fired, in-line twin-cylinder internal combustion engine incorporating various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Schematically shown in the drawings is a two-cycle internal combustion engine 11 including first and second cylinders 13 and 15 which are in aligned parallel relation to each other and which fire alternately, i.e., which alternately fire at 180° intervals of crankshaft rotation.

The engine 11 also includes first and second crankcases 23 and 25 which respectively extend from the first and second cylinders 13 and 25 and which rotatably support a crankshaft 27. Operably connected to the crankshaft 27 are first and second connecting rods 33 and 35 which, in turn, are respectively operably connected to first and second pistons 43 and 45 reciprocally movable within and relative to the first and second cylinders 13 and 15 and the first and second crankcases 23 and 25. Also fixed to the crankshaft 27 is a flywheel 47. The other end of the crankshaft 27, in effect, becomes an output shaft 49.

Extending respectively from the first and second crankcases 23 and 25 are first and second carburetors 53 and 55 which respectively include first and second air induction passages 63 and 65 respectively including first and second throttle valves 73 and 75 which are movable between open and closed positions and which are shown in the closed or idle speed position. Preferably, the throttle valves 73 and 75 are connected by a linkage (not shown) to effect simultaneous and common movement thereof.

The first ad second air induction passages 63 and 65 respectively communicate with the first and second crankcases 23 and 25 through respective first and second reed valves 83 and 85.

If desired, first and second intake manifolds 93 and 95 can be respectively located between the first and second reed valves 83 and 85 and the first and second air induction passages 63 and 65. However, the intake manifolds 93 and 95 can functionally be considered part of the air induction passages 63 and 65.

The first and second air induction passages 63 and 65 also respcctively include first and second venturi portions 103 and 105 located upstream of the movable throttle valves 73 and 75 and respectively communicate with first and second high speed nozzles 113 and 115.

The first and second carburetors 53 and 55 also respectively include first and second float bowls or fuel reservoirs 123 and 125. Located within the first and second fuel reservoirs 123 and 125 are respective first and second fuel wells 133 and 135 which respectively communicate with the first and second reservoirs 123 and 125 through first and second high speed fuel control orifices 143 and 145, with the first and second high speed nozzles 113 and 115, and with first and second high speed air bleeds 153 and 155.

The first and second carburetors 53 and 55 also respectively include first and second idle/low speed conduits or ducts 163 and 165 which can extend axially through the first and second nozzles 113 and 115 and across the first and second air induction passages 63 and 65 as shown, or can extend around the first and second air induction passages 63 and 65, and which respectively communicate with first and second calibration pockets 173 and 175, which, in turn, respectively communicate through first and second low speed metering ports or secondary orifices or holes 183 and 185 with the first and second air induction passages 63 and 65 in the area immediately adjacent to the throttle valves 73 and 75 when the throttle valves 73 and 75 are located in the closed positions.

Communicating with the first and second idle/low speed conduits 163 and 165 are respective first and second idle/low speed air-bleed orifices 193 and 195.

Also communicating with the first and second calibration pockets 173 and 175 are respective first and second idle speed conduits or ducts 203 and 205 which respectively communicate with first and second idle speed ports 213 and 215 which respectively communicate with the first and second air induction passages 63 and 65 in the area between the throttle valves 73 and 75 and the reed valves 83 and 85. As noted above, the intake manifolds 93 and 95 are considered, in this disclosure, as a part of the air intake passages 63 and 65 and, thus, the first and second idle ports 213 and 215 can be located either in the air induction passages 63 and 65 or in the intake manifolds 93 and 95 and still be located between the throttle valves 73 and 75 and the reed valves 83 and 85.

Located in the idle speed ducts 203 and 205 are respective first and second idle speed mixture control needles or valves 220 and 225 which are respectively adjustable relative to first and second valve seats 233 and 235 to control the rate of idle speed fuel flow.

The engine is operable between an idle speed (approximately 650 to 700 RPM), a low speed range (approximately from 650 to 700 RPM to about 1500 RPM), and a high speed range (above about 1500 RPM).

As above disclosed, the construction is conventional.

It has been discovered that, at times, and particularly during engine operation at idle speed and in the low speed range (when the throttle valves 73 and 75 are substantially closed) that full and complete closure of the reed valves 83 or 85 is not obtained during piston movement from top dead center to bottom dead center positions, with the result that relatively high pressure fuel/air mixture pulses travel backwardly from the crankcases 23 and 25 through the incompletely closed reed valves 83 and 85 and into the associated air induction passages 63 and 65. Such positive fuel/air mixture pressure pulses are believed to adversely effect fuel flow from the calibration pockets 173 and 175 through the secondary orifices or holes 183 and 185 and into the air induction passages 63 and 65 upstream of the throttle valves. As a consequence, upon subsequent piston movement from bottom dead center to top dead center positions and, when pressure in the air induction passages again becomes negative and causes inflow of fuel/air mixture into the crankcase, the incoming fuel/air mixture is disadvantageously enriched with fuel discharged into the air induction passage 63 and 65 by the backwardly traveling positive pressure pulses.

In order to reduce or eliminate such positive pressure pulse activity in the carburetors, the engine includes a conduit 251 which communicates between the air induction passages 63 and 65 in the areas between the throttle valves 73 and 75 and the reed valves 83 and 85. In the specifically disclosed construction, the conduit 251 communicates with the idle speed ports 213 and 215 downstream from the idle speed mixture control needles 213 and 215. As a consequence, and because the cylinders are alternately fired, the negative pressure present in one of the air induction passages when the associated piston is moving from bottom dead center position to top dead center position is transmitted or communicated to the other air induction passage at about the time of positive pressure pulse travel backwardly into the other air induction passage. Such transmission or communication counteracts the effect of the backwardly traveling positive pressure pulses in the other air induction passage, with the result that substantial fuel is not discharged from the other calibration pocket into the other air induction passage and the presence of unwanted excess fuel in the other air induction passage is substantially reduced or avoided. The same operation occurs again 180° later, only the negative pressure from the other air induction passage then advantaeously eliminates or substantially reduces the effect of backwardly traveling positive pressure pulses in the first mentioned air induction passage. The result is an engine which runs more smoothly at idle and low speeds.

While the preferred embodiment of the invention uses alternately fired in-line twin cylinders. The invention is also applicable to opposed or oppositely arranged twin cylinder engines and to paired cylinders of V-block multi-cylinder engines. In addition, it is believed that at least some of the advantages of the invention can be obtained if the connected carburetors are associated with engine cylinders which fire at crankshaft rotation intervals somewhat less than 180°, so long as there is sufficient overlap between the time of negative pressure in one air induction passage and backwardly traveling positive pressure pulses in the other air induction passage.

While the disclosed invention has been shown in connection with a single two cylinder alternately fired engine, it is clearly applicable to any multi-cylinder engine which includes one or more pairs of alternately fired cylinders.

Various of the features of the invention are set forth in the following claims.

We claim:

1. A two stroke internal combustion engine comprising first and second alternately fired cylinders, first and second crankcases respectively extending from said first and second cylinders, first and second carburetors respectively including first and second air induction passages respectively extending from said first and second crankcases, first and second reed valves respectively affording communication between said first and second crankcases and said first and second air induction passages, first and second throttle valves respectively movably mounted in said first and second air induction passages, first and second ports respectively communicating with said first and second air induction passages in the respective areas between said first and second throttle valves and said first and second reed valves, and means directly communicating between said first and second air induction passages in the respective areas between said first and second throttle valves and said first and second reed valves.

2. A two stroke internal combustion engine comprising first and second alternately fired cylinders, first and second crankcases respectively extending from said first and second cylinders, first and second carburetors respectively including first and second air induction passages respectively extending from said first and second crankcases, first and second reed valves respectively affording communication between said first and second crankcases and said first and second air induction passages, first and second throttle valves respectively movably mounted in said first and second air induction passages, first and second idle speed ports respectively communicating with said first and second air induction passages and respectively located between said first and second throttle valves and said first and second reed valves, and a conduit communicating between said first and second idle speed ports.

* * * * *